United States Patent [19]

Derrick

[11] Patent Number: 4,901,117

[45] Date of Patent: Feb. 13, 1990

[54] SHEET FEEDER FOR SECOND PASS COPY SUBSTRATE

[75] Inventor: John F. Derrick, Williamson, N.Y.

[73] Assignee: Xerox Corporation, Stamford, Conn.

[21] Appl. No.: 252,617

[22] Filed: Oct. 3, 1988

[51] Int. Cl.[4] ..... G03G 15/00

[52] U.S. Cl. ..... 355/309; 355/24; 271/118

[58] Field of Search ..... 355/319, 309, 24; 271/3.1, 10, 21, 109, 117, 118, 121

[56] References Cited

U.S. PATENT DOCUMENTS

| | | | |
|---|---|---|---|
| 4,053,152 | 10/1977 | Matsumoto | 271/118 X |
| 4,508,332 | 4/1985 | Nishio | 271/118 |
| 4,660,963 | 4/1987 | Stemmle | 355/24 |
| 4,697,911 | 10/1987 | Kajita et al. | 355/319 |
| 4,717,139 | 1/1988 | Sootome | 271/118 X |

FOREIGN PATENT DOCUMENTS

| | | |
|---|---|---|
| 56-23134 | 3/1981 | Japan . |
| 60-68355 | 4/1985 | Japan . |
| 61-2630 | 1/1986 | Japan . |

OTHER PUBLICATIONS

"Automatic Sequential Document Stack" IBM Technical Disclosure Bltn. vol. 14, No. 9, 2/72, p. 2789 to Rubeling, Sr.

*Primary Examiner*—R. L. Moses

[57] ABSTRACT

A sheet feeder for feeding sheets from a support platform comprising a sheet support platform, a rotatable sheet feed roll reciprocally movable between a sheet feeding position wherein it is in feeding engagement with the top sheet when at least one sheet is on said support platform and a retracted standby position wherein it is retracted from feeding engagement with said the top sheet and a movable sheet restrictor member positioned by gravity to maintain the top sheet spaced from the rotatable feed roll when the feed roll is in the retracted standby position. In a preferred embodiment the sheet feeder prints for a second pass through a printing machine.

19 Claims, 8 Drawing Sheets

SHEET FEEDER FOR SECOND PASS COPY SUBSTRATE

BACKGROUND OF THE INVENTION

The present invention relates to a sheet feeder and electrostatographic printing machines employing such sheet feeder which enables the improved feeding of copy substrates which have been passed through the printing machine one time and have a heat fused toner image thereon through a second pass into the printing machine to provide a duplex image or a second color image on the same side the first image is printed.

In an electrostatographic reproducing apparatus commonly in use today, a photoconductive insulating member is typically charged to a uniform potential and thereafter exposed to a light image of an original document to be reproduced. The exposure discharges the photoconductive insulating surface in exposed or background areas and creates an electrostatic latent image on the member which corresponds to the image areas contained within the usual document. Subsequently, the electrostatic latent image on the photoconductive insulating surface is made visible by developing the image with developing powder referred to in the art as toner. Most development systems employ a developer material which comprises both charged carrier particles and charged toner particles which triboelectrically adhere to the carrier particles. During development the toner particles are attracted from the carrier particles by the charge pattern of the image areas in the photoconductive insulating area to form a powder image on the photoconductive area. This image may subsequently be transferred to a support surface such as copy paper to which it may be permanently affixed by heating or by the application of pressure. Following transfer of the toner image to a support surface, the photoconductive insulating member is cleaned of any residual toner that may remain thereon in preparation for the next imaging cycle.

Commercial applications of this apparatus have become increasing complex offering the users a variety of printing and copying options. One of the options of particular interest to a growing variety of customer applications is the capability for such machines to produce duplex prints and copies. By duplex copying or printing it is intended to define copies on which both sides of a single sheet are provided with fused toner images. Another capability being provided in copying and printing machines with increasing frequency is that of being capable of providing two color or highlight color simplex, toner images on one side only of the copy or print. Both of these capabilities present significant problems in the handling of the copy substrates in an automatic printing or copying machine since the copy substrate on which the duplex image is formed or the second color or highlight color image is formed has already passed through the printing machine once to have the first toner image formed. In completing the first toner image the copy substrate is passed through a fuser which typically is at a temperature of about 400° F. to thereby raise the temperature of the thermoplastic toner material to a level at which it will coalesce and penetrate into the substrate typically the paper fibers. As a result of this heating which is also typically performed in a heated roll fuser using both heat and pressure between the fuser roll and a pressure roll, the copy substrates are subjected to sufficient stress that they have a slight amount of curl or other nonplanar deformity resulting in poor stacking between adjacent sheets. As a result, the first produced copy substrates having fused toner images thereon when collected in a supply tray within the printing machine for subsequent duplex or second color reproduction do not stack the way virgin copy substrates stack but rather stack with nonuniform gaps or air pockets between adjacent copy substrates. This tendency of such copy substrates to fluff creates feeding difficulties in sheet feeders used to feed the copy substrates from the collection tray for the second pass through the printing or copying apparatus. The difficulties are particularly pronounced in sheet feeders wherein a feed roll is reciprocally moved between a sheet feeding position where it is in feeding engagement with the top sheet in a stack of sheets in the supply tray and a retracted position wherein it is retracted from feeding engagement with the top sheet. The difficulty is encountered in that typically the feed roll is rotated at times other than when it is actually feeding a sheet while in the feeding position and a fluffed sheet may come in contact with the feed roll producing undesired sheet feeding including random feeds and multisheet feeds. In some applications this difficulty may be exacerbated by the generation of static electricity in the feeding system resulting in the top sheet in the stack being electrostatically attracted to the feed roll even when it is not rotating so that upon subsequent rotation it can also result in undesired sheet feeding. This occurs because the movement of the feed roll as well as the reciprocal movement of the feed head can generate static electricity even in virgin paper. This is particularly true in those systems wherein the feed roll and the feed head are moving at times when they are is not feeding sheets. Thus, even if a feed roll is not rotating it may pick up a sheet because of the static electricity so that when the feed roll is subsequently rotated an undesired feed may be realized.

While the presence of a static eliminator devices may be effective in removing some of the effects of static electricity they have no effect on the undesired feeding of the top sheet in a stack created by the curl in the paper. The difficulties described above may be more fully appreciated with reference to schematics illustrated in FIGS. 1A and 1B. In FIG. 1A, which is a stack of fresh or virgin paper, paper that has not been passed through the printing or copying machine fuser system at least once, is provided on the sheet support platform 10. The articulating or reciprocating movable feed roll 12 is illustrated in solid line as being in the retracted standby position and in dashed line as being in sheet feeding engagement with the top sheet in the stack and the retard pad. In FIG. 1B, however, the sheets on the sheet support platform have been passed through the printer or copy or fuser system at least once resulting in the creation of curl in the copy sheets so that they do not lie flat during stacking but rather air pockets are created between adjacent sheets such that even when the sheet feed roll is in the retracted standby position and rotating it is possible for the top sheet in the stack of sheets on the sheet support platform to contact the rotating feed roll and be fed forward at a time when such feeding is not desired.

PRIOR ART

U.S. Pat. No. 4,660,963 to Stemmle describes an integral removable duplex module for use in conjunction with a reproduction processor including two paper trays, a first operable as a duplex copy buffer tray or a paper tray and a second operable as an auxiliary paper tray, each tray having a copy sheet feeder associated therewith comprised of a single cam operated mechanism having two cantilevered arms supporting constantly rotating feed rollers suspended above each paper tray and associated tray elevator mechanisms which enhance copy sheet feeding when the feed rollers are pivoted toward the trays into copy sheet feeding position and maintain copy sheet trays in non-feeding positions during non-feeding opeation. Copy sheets are received in the duplex copy buffer tray from the reproduction processor via a reversible exit nip at the output of the processor, which directs sheets passed to an output back to a duplex module paper path for repassing through the reproduction processor. Paper entering the module may be directed to either the duplex copy buffer tray or a trayless path which passes copy sheets directly back to the processor. A method for operating the duplex module is described to efficient use of the trayless path by directing copy sheets thereto depending on the number of copies to be made. Accordingly, copy sheets may be directable to the duplex tray or trayless path at various times during any run. Duplex operations are disabled on separation of the module from the reproduction processor.

SUMMARY OF THE INVENTION

In accordance with the principle aspect of the present invention a sheet feeder for feeding sheets from a support platform is provided comprising a sheet support platform, a rotatable sheet feed roll, means to reciprocally move the feed roll between a sheet feeding position wherein the feed roll is in feeding engagement with the top sheet when at least one sheet is on the support platform and a retracted standby position wherein said feed roll is retracted from feeding engagement with the top sheet and including a movable sheet restrictor member positioned by gravity to maintain that the top sheet spaced from the rotatable feed roll when the feed roll is in the retracted standby position.

In a further principle aspect of the present invention a printing machine with means to form a toner image on a sheet substrate and means to heat fuse the toner image to the sheet substrate is provided with a sheet substrate collection tray for collecting sheet substrates having at least one fused toner image thereon having a sheet support platform and operatively associated therewith, a sheet feeder for feeding the sheets having at least one fused toner image thereon through the means to form a toner image and means to heat fuse said toner image to provide a sheet substrate having toner images fused on both sides or a sheet substrate having more than one color toner image fused on one side.

In a further aspect of the present invention the feed roll is rotatably mounted on a feed arm which is reciprocally mounted to move the feed roll between the sheet feeding position and the retracted standby position and the movable sheet restrictor member comprises two restrictor arms one on each side of the feed roll which are pivotally mounted to a shaft fixedly located relative to the feed arm to enable the restrictor arms to pivot about the shaft by gravity when the feed roll is in the retractive standby position.

In a further aspect of the present invention the two restrictor arms have apertures there through which the feed arm extends, the apertures being larger than the feed arm whereby said restrictor arms are pivotally movable about said feed arm.

In a further aspect of the present invention the sheet restrictor members are of sufficient weight to maintain the top sheet spaced from said rotatable feed roll when the feed roll is in the retracted standby position and are of insufficient weight to substantially inhibit the sheet feeding performance of the feed roll when it is in the sheet feeding position.

In a further aspect of the present invention, friction retard means are provided for cooperative engagement with the feed roll forming a nip therebetween when the feed roll is in the sheet feeding position.

In a further aspect of the present invention the feed roll is reciprocally moved for the feeding of each individual sheet and is continuously rotated.

In a further aspect of the present invention the feed roll is maintained at the sheet feeding position and rotated periodically for the feeding of successive sheets.

Other features of the present invention will become apparent as the following description proceeds and upon reference to the drawings.

BRIEF DESCRIPTION OF THE DRAWINGS

FIG. 3A shows the intersection in the reproduction processor where the direction of copy sheets from the reproduction machine is reversed to the duplex module paper path, while

DETAILED DESCRIPTION OF THE PREFERRED EMBODIMENT

The invention will now be described with reference to a preferred embodiment of the sheet feeder and printing apparatus embodying the same.

Figure 2:
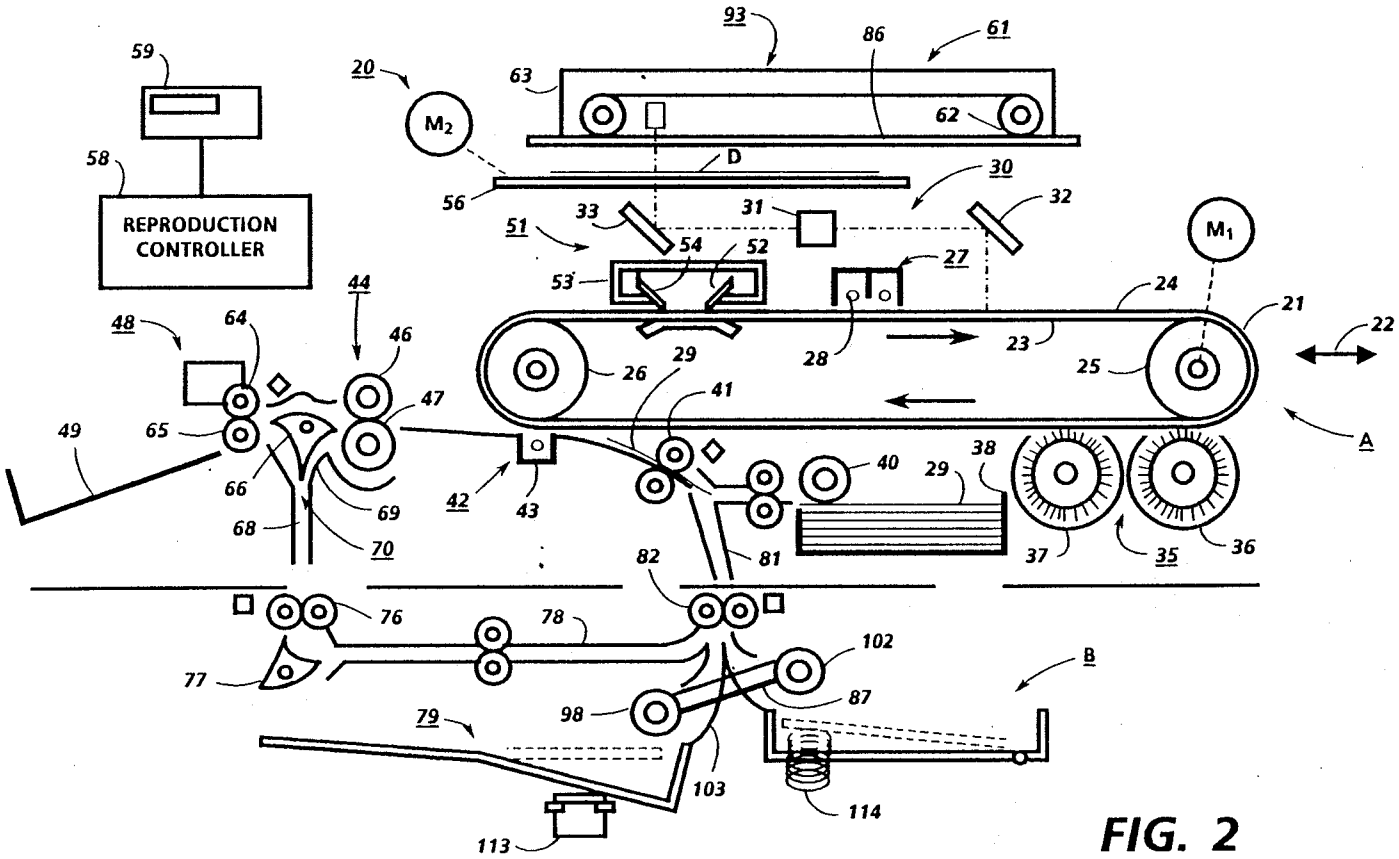
FIG. 2 is a schematic representation in cross section of an automatic printing, printing machine which may include the sheet feeder according to the present invention.

The reproducing machine depicted in FIG. 2 illustrates the various components utilized therein for producing copies from an original document. It should become evident from the following description that the invention described herein is equally well suited for use in a wide variety of processing systems including other reproduction systems, and is not necessarily limited in application to the particular embodiment or embodiments shown herein.

The printing machine 20 illustrated in FIG. 2 employs a removable processing cartridge 21 which may be inserted and withdrawn from the main machine formed in the direction of arrow 22. Cartridge 21 includes a belt like photoreceptor member 23, the outer periphery of which is coated with a suitable photoconductive material 24. The belt is suitably mounted for revolution within the cartridge about driven transport rolls 25 and 26, and travels in the direction indicated by the arrows on the inner run of the belt to bring the image bearing surface thereon past the plurality of conventional xerographic processing stations. Suitable drive means such as motor $M_1$ are provided to power and coordinate the motion of the various cooperating machine components whereby a faithful reproduction of the original input image information is recorded upon a copy sheet 29, such as a paper or the like.

Initially, photoreceptor 23 is passed through a charging station 27 wherein photoreceptor 23 is uniformly charged with an electrostatic charge placed on the photoconductive surface 24 by charge corotron 28 in a known manner preparatory to imaging. Thereafter photoreceptor 23 is exposed to the light from the input image whereby the charge is selectively dissipated in the light exposed regions to record the input image in the form of electrostatic latent image. The document is scanned with a multi mirror scanning optics system 30 including stationary lens 31 and a pair of cooperating movable scanning mirrors 32,33. The scanning mirrors include a half rate mirror 32 and a full rate mirror 33 supported on carriages (not shown) for scanning movement. Multi mirror scanning system 30 is of a type well known in the art. A suitable development station 35 could include a magnetic brush development system, including developer roll 36, utilizing a magnetizable developer mix having coarse magnetic carrier granules and toner colorant particles. In one embodiment of the invention means may be provided to select among a choice of colored toners to apply images onto copy sheets in different colors. This is illustrated by a second developer roll 37 for a second color.

Paper sheets 29 are supported in a stack arrangement on elevated stack support tray 38. With the stack at its elevated position, the sheet separator feed roll 40 feeds individual sheets therefrom to the registration pinch roll pair 41. The sheet is then forwarded to the transfer station 42 in proper registration with the image on the belt, and the developed image on the photoconductive surface 24 is brought into contact with copy sheet 29 within the transfer station 42, and the toner image is transferred form the photoconductive surface 24 to the contacting side of the copy sheet 29 by means of transfer corotron 43. Following transfer of the image, the copy sheet, which may be paper, plastic etc., as desired, is separated from photoreceptor 23 by the beam strength of copy sheet 29 as it passes around the curved face of photoreceptor 23 around the transport roller 26 and the copy sheet containing the toner image thereon is advanced to fusing station 44 wherein the transferred powder image is affixed to the copy sheet by being transported between an internally heated fuser roll 46 in contact with the toner image and backup pressure roll 47. After fusing the toner image to the copy sheet, copy sheet 29 is advanced to the reversible exit nip 48 from where it may be directed to sheet stacking tray 49 or to the input of a sorter (not shown) or directed to the duplex path.

Although a preponderance of toner is transferred to the copy sheet 29, invariably some residual toner remains on the photoconductive surface 24 after the transfer of the toner image to the final support material or copy sheet. The residual toner particles remaining on the photoconductive surface after the transfer operation are removed form the belt 23 by the cleaning station 51 which comprises a cleaning blade 52 in scrapping contact with the outer periphery of the belt 23, and contained within cleaning housing 53 which has a cleaning seal 54 associated with the upstream opening of the cleaning housing. Alternatively, the toner particles may be mechanically cleaned from the photoconductive surface by a cleaning brush as is well known in the art.

When the copier is operated in the conventional mode, original document D to be reproduced is placed on platen 56 which is scanned by multi mirror scanning optics 30 which directs light from the document to the photoreceptor 23 for copying. The speed of photoreceptor 23 and scanning optics 30 are synchronized to provide for accurate reproduction of the document. Platen 56 is preferably large enough to support at least two $8\frac{1}{2}\times 11$ inch documents disposed on the platen with their long edges adjacent in side-by-side relationship, perpendicular to the plane of drawing of FIG. 2. Servo motor $M_2$ drives scanning optics 30 in its motion by platen 56 and is controllable by the reproduction processor controller 58 to selectively scan platen 56, whereby only a portion of a selected document on the platen is copied. Additionally, while in normal copying operation the scanning optics are moved along a path from a home position to a position required to complete exposure of a document to be copied, servo motor $M_2$ is also controllable to provide repeated copying of such document, and returning scanning optics 30 to a "start of scan" position other than a normal home position for such copying.

Reproduction processor controller 58 is preferably a known programmable controller or combination of controllers, which conventionally controls all of the other machine steps and functions described herein including the operation of the document feeder, the paper path drives in both the reproduction processor A and duplex module B etc. The controller 58 also conventionally provides for storage and comparisons of counted values including copy sheets and documents, and numbers of desired copies, and control of operations selected by an operator through alphanumeric display and control panel 59.

An automatic document feeder 61 is optionally provided and is controllable by the reproduction processor controller 58. Documents are fed into the device at document input 62 and are passed across platen 56 for copying, and exit the feeder at document output 63.

It is believed that the foregoing general description is sufficient for the purposes of the present application to illustrate the general operation of an automatic xerographic copier which can embody the apparatus in accordance with the present invention. It will be appreciated that while the present invention finds particularly advantageous use with respect to the described arrangement, the principles of operation may be used in many other embodiments.

With continued reference to FIG. 2 and additional reference to FIG. 3, the duplex module and paper path are illustrated. The reversible exit nip 48 is provided with a motor (not shown) for driving roller 64 in forward, reverse and stop motion. The motor may advantageously be a stepper motor of the sort well known in the art. Reproduction processor controller 58 instructs the motor to drive the drive roller 64 of the exit nip 48 as required by the copying function in process. Thus, for simplex copying of a document, or completed duplex copying of a document, roller 64 is driven in a forward direction to drive copy sheet to output tray 49 thereby serving as an output driver. In the case where the copy sheet is required to receive a second side image for a duplex copy, roller 64 is driven first in a forward direction until the copy sheet trail edge has cleared deflector 66, and subsequently in reverse direction to drive the copy sheet back into reproduction processor 20 through the duplex module. The process of changing direction while the copy sheet is in exit nip 48 serves to change the trail edge of the copy sheet to the lead edge to enable inversion of the document to receive a second side copy. In certain cases, it will be desirable to hold a copy sheet while the processor advances previously returned copy sheets in order to correctly time the return of all the copy sheets to the processor for receiving a second image. In this case, roller 64 is stopped and the copy sheet is held between rollers 64, 65 until a control signal is received from controller 58 by the motor, directing it to drive the paper in either forward or reverse motion.

In operation, reversible exit nip 48 receives the copy sheet between rollers 64 and 65 from the exit nip of fuser station 44. The copy sheet is passed thereinbetween until the trailing edge clears the deflector 66 of the copy sheet path 69 from the fuser 44 and the duplex module copy sheet path 68. As more clearly seen in FIG. 3B, passive deflector 66 is situated slightly higher than reversible exit nip, and extends into the paper path 69 to block the returning copy sheets and direct them to the duplex path 68.

Figure 3A:
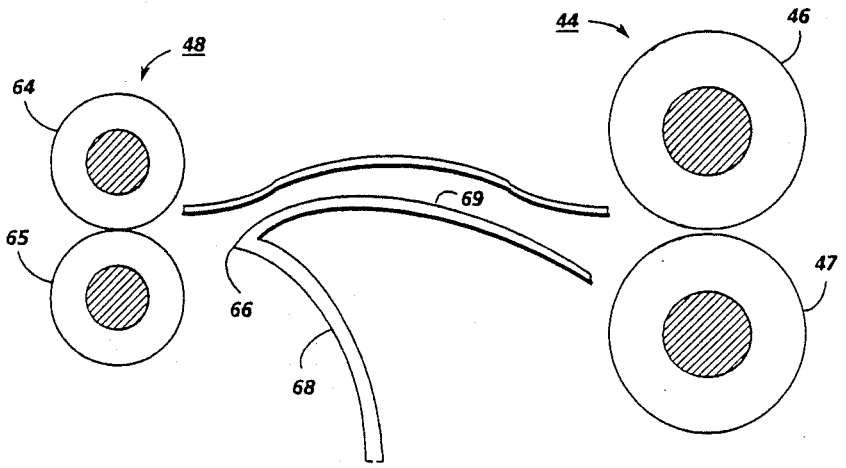
Figure 3B:
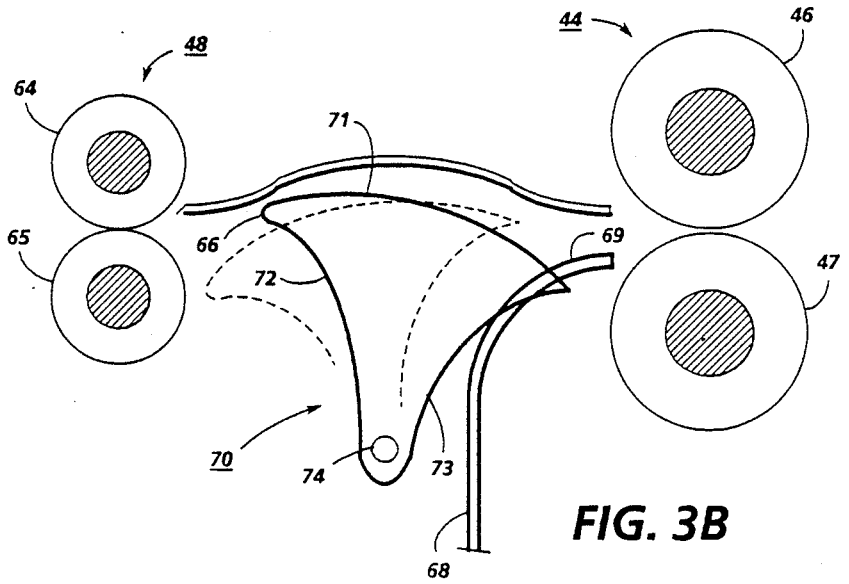
FIG. 3B shows the same intersection including a deflector for second pass color copying.

Passive deflector 66 may advantageously be provided on toggling image merging path selector 70 best shown and compared to a standard deflector 66 in FIGS. 3A and 3B. In this case, selector 70 is comprised of a generally triangular member having an upper convex surface 71 forming the end portion of copy sheet path 69 from the fuser to deflector 66 in normal copying processes; and providing concave surface 72, facing the reversible exit nip 48 to define the uppermost portion of duplex module copy sheet path 68. When image merging copying (two images or colors on the same side) is desired, reversal of the copy sheet lead and trail edges is not required, and the image merging path selector 70 is pivoted about axis 74 (as shown in phantom in FIG. 3B) closing access to deflector 66 to keep copy sheets from entering reversible exit nip 48, and create a path formed by concave surface 73 and leading directly from copy sheet path 69 to duplex module copy sheet path 68. Copy sheets passed through the duplex module in this manner are returned to the reproduction processor presenting the same side for copying as was presented the first time through. Thus, either a new image or a colored image may be overlayed thereon.

As seen in FIG. 2, copy sheets to receive a second image thereon are passed downwardly from the passive deflector 66 along duplex module copy sheet path 68. For the purpose of description, these sheets will be assumed to be receiving an image on the second side thereof, and will be described as such, although it will be appreciated that such sheets could be receiving a second image overlayed on the first side image. Where appropriate, the image merging process will be mentioned with particularity. Advantageously, the duplex module 13 may be placed in a drawer which is movable into and out of position under processor A in a direction perpendicular to the plane of FIG. 2. The drawer may therefore be pulled outwardly from the front of the machine.

Copy sheets are passed from the reversible exit nip 48 past the passive deflector 66 via duplex paper path 68 to duplex module entry nip 76 which pass the copy sheet into the duplex module B. On passing duplex module entry nip 76, sheets are passed to duplex deflector baffle 77. Duplex deflector baffle 77 serves to direct copy sheets to either trayless path 78 or duplex tray 79. Deflector baffle 77 is controllable in response to reproduction processor controller 58, in accordance with the copying functions the operator has selected. When duplex deflector baffle 77 is in place to block entry of copy sheets into the trayless path 78, such copy sheets are directed into duplex tray 79. Copy sheets which are passed to duplex tray 79 are refed therefrom to reproduction processor duplex entry path 81 through duplex module exit nip 82 to re-enter the reproduction processor 20 for receiving a second side copy.

Figure 4:
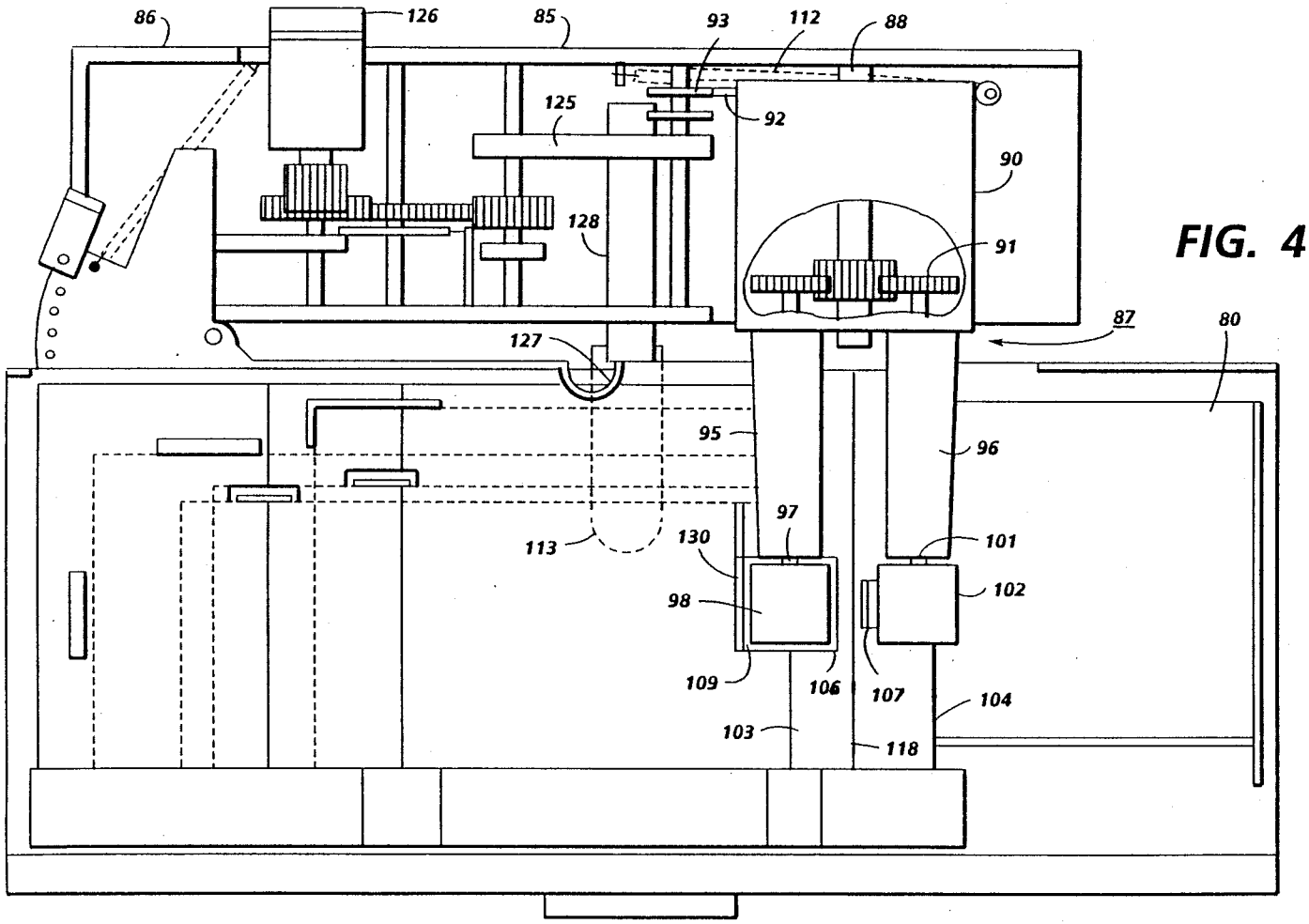
FIG. 4 shows a plan view of the duplex module.
Figure 5:
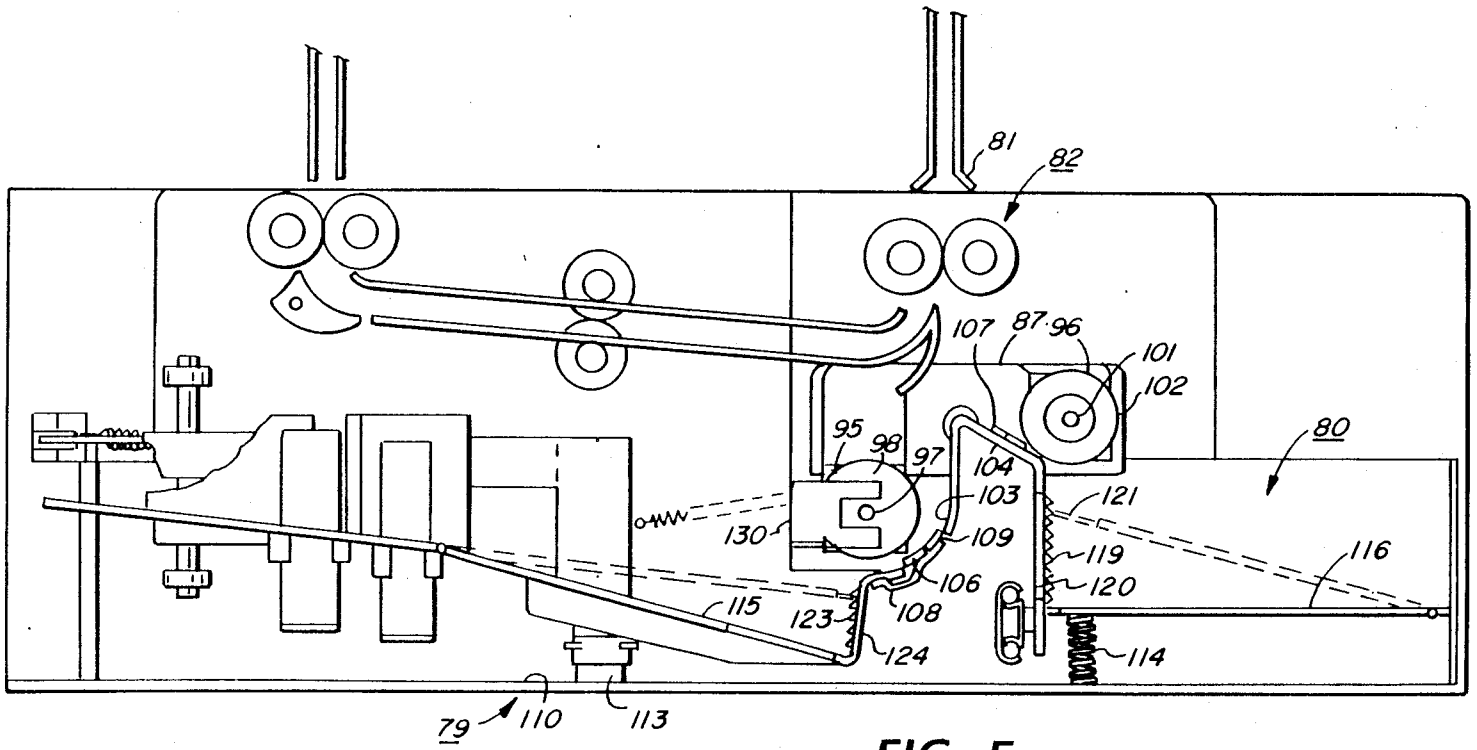
FIG. 5 shows a front sectional view of the paper path and operating components of the duplex module.

As illustrated in FIGS. 4 and 5, paper supporting elevator 115 is provided in duplex tray 79 supported for pivoting movement in the vertical direction with respect to drawer support surface 110. When documents are fed to elevator 115 or added to the tray for auxiliary paper tray operation, the elevator 115 is lowered to assist in advancing the copy sheets to the most forward point in the tray for registration against the forward most wall in the tray. For feeding copy sheets out of the tray, a leaf spring 113, located between the elevator 115 and drawer support surface 110, biases the elevator 115 upwardly. Rotation of elevator cam member 125 by duplex motor 126 raises the tray when required by forcing downwardly on a section of the spring behind knife edge pivot 127 thereby lifting the portion of the spring underneath the tray. Leaf spring 113 is supported for pivoting movement at a pivot point between the leaf spring 113 and tab 128 so that release of the bias on tab 128 by elevator cam 125 lowers leaf spring 113 and elevator 115. Additionally, as the leaf spring 113 is mounted on the drawer while elevator cam 125 is located on frame 86 movement of the drawer outwardly from the frame 86 releases the bias on tab 127. It will no doubt be appreciated as well that the elevator 115 is lowered when the drawer is pulled outwardly, since outward movement of the drawer disengages leaf spring 113 from cam 125 to release the biasing force on the elevator plate thereby facilitating loading of paper into the tray 79.

Turning now to FIGS. 4–9 a principle aspect of the present invention is illustrated. A friction retard copy sheet feeder assembly for feeding copy sheets from the duplex tray 79 and auxiliary tray 80, to reproduction processor duplex entry path 81 in accordance with the desired copying options is provided. As best seen in FIGS. 4 and 5, extending perpendicularly from the rear side 85 of frame 86, and extending forward over duplex tray 79 and auxiliary tray 80 is feeder toggle carriage 87. Feeder toggle carriage 87 is pivotally mounted on the rear frame portion 85 via carriage pivot shaft means 88. Feeder toggle carriage 87 is comprised generally of a gear box section 90 which holds transmission 91, driven by a drive gear (not shown) extending outwardly from reproduction processor. Extending from gear box section 90, perpendicularly to carriage pivot shaft means 88 is a cam follower means 92. Cam follower means 92 is biased by toggle carriage cam 93 to neutral copy sheet feeding positions as will be described thereby moving feeder toggle carriage 87 to appropriate positions.

Extending cantilevered forwardly across the duplex and auxiliary trays 79 and 80 from gear box section 90 are duplex tray feeder arm 95 and auxiliary tray feeder arm 96. Extending through duplex tray feeder arm is a duplex tray feed roller shaft 97 driven for rotational motion thereof by the drive gear from the reproduction processor via transmission 91 in gear box section 90. The opposite end of duplex tray feed roller shaft 97 is cantilevered over the duplex tray and supports a duplex tray feed roller 98 for rotational motion. The duplex tray feed roller 98 is driven for constant rotation, and will contact copy sheets in the tray to impart motion thereto when pivoted into copy sheet feeding position. Auxiliary tray feeder arm 96 is comprised of generally the same elements including auxiliary tray feed roller shaft 101 supporting for constant rotational motion auxiliary tray feed roller 102. It will be appreciated that while the feed roller is shown here as a preferred embodiment, any friction feeding arrangement, mountable for copy sheet engagement at one end of the feeder arms would find suitable use. Thus for example, a paddle feeder arrangement or multi roll feeder are suitable for use in conjunction with the described arrangement.

Toggle carriage cam 93 biases feeder toggle carriage 87 in a pivoting motion between a position required for feeding sheets and a nonfeeding position. Since it is desirable to avoid the cost of a clutch in low cost copiers, feed rollers 98, 102 are in constant motion, and must be moved to a neutral position when copy sheet feeding is not desired. Accordingly, for feeding from duplex tray 79, toggle carriage cam 93 rotates to bias feeder toggle carriage 87 via cam follower means 92 downwardly to provide feeder arm 95 in a lowered position and supporting feed roller 98 immediately above copy sheets in duplex tray 79. When it is desired that copy sheets be fed from duplex tray 79, the toggle carriage cam 93 biases feeder toggle carriage 87 to a copy sheet feeding position to bring feed roller 98 downwardly contacting with a copy sheet to feed such sheet from the stack and advance the sheet between roller 98 and surface 103. For feeding from auxiliary tray 80, toggle carriage cam 93 biases feeder toggle carriage 87 via cam follower means 92 upwardly to rotate toggle carriage 87 to provide auxiliary tray feeder arm 96 supporting feed roller 102 in position immediately above auxiliary tray 80. When feeding from auxiliary tray 80 is desired, the toggle carriage cam 93 biases feeder toggle carriage 87 to a copy sheet feeding position to bring feed roller 102 downwardly contacting a copy sheet to feed such sheet from the paper stack in auxiliary paper tray 80 and between roller 102 and surface 104.

Figure 6:
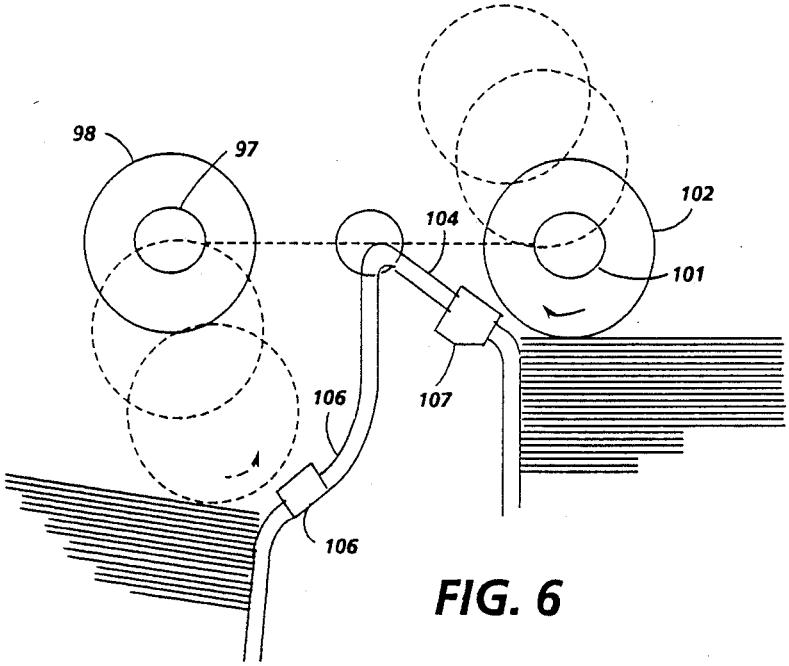
FIG. 6 shows a somewhat schematic view of the rotational motion of the feeder assembly with respect to the copy sheet trays.

FIG. 6 schematically illustrates the movement of the rollers from a neutral starting position, to a position above the tray and to a copy sheet feeding position. In combination with feed rollers 98 and 102 guide baffles 103 and 104 are provided with retard pads 106 and 107 respectively to aid in the separation of copy sheets from a stack during feeding operation from either tray. In accordance with the invention, retard pad 106 is mounted on a retard spring member 108 to be biased through retard opening 109. Retard spring member108 is mounted at its other end on guide baffle 103. In operation, retard pad 106 is biased for firm sheet feeding engagement with feed roller 98.

Feeder toggle carriage 87 is spring biased for rotational movement towards auxiliary tray 80 by spring member 112, (see FIG. 4) which is connected at a first end on the interior of the duplex module rear surface 86 on the duplex tray side of feeder toggle carriage 87, and at a second end on feeder toggle carriage 87 on the auxiliary tray side thereof. Spring member 112 is arranged to provide a downward biasing force on feeder toggle carriage 87 and auxiliary tray feeder roller 102. This downward biasing force provides feed roller 102 in film engagement with retard pad 107 in the same manner as provided for the combination of feed rollers 98 and retard pad 106 and retard pad spring 108.

In combination with the downward pivoting motion of feeder arms 95, 96, duplex and auxiliary trays 79, 80 are mounted on spring members 113 and 114 for upward biasing to bring copy sheets stacked therein into position for copy sheet feeding. To this end, duplex elevator 115 and auxiliary tray elevator 116 are mounted to be upwardly biased to bring the ends of the elevators 115 and 116 adjacent abutment 118 into position for copy sheet feeding. To counter the natural tendency of the spring biased trays to follow the feed rollers when feed rollers 98 and 102 are moved out of copy sheet feeding positions with respect to the trays, means are provided to maintain the trays in the positions obtained when the rollers 98 and 102 are pivoted out of position. Ratchet member 119 is mounted for pivoting movement and normally biased through an opening 120 in abutment 118 for engagement with tab means 121 mounted on an adjacent portion of auxiliary tray elevator 116. Ratchet member 123 is mounted on ratchet lever member 124 whereby movement of toggle carriage 87 into either copy feeding position biases the ratchet lever member of the ratchet member to disengage with the tray tab member engaged thereto. Accordingly, the spring bias associated with the tray forces the tray upwardly to provide the copy sheets in engagement relationship with the feeder rollers. Since the feeder rollers 98 and 102 are constantly rotating feeding begins immediately, the rollers must be removed from copy sheet engagement between feeding cycles. When a copy sheet reaches duplex module exit nip 81 the engaged feed arm is lifted out of engagement with the paper. When the feed arms are pivoted out of position, the ratchets are engaged to prevent the spring biased trays from following the arm motion. Alternatively, a fixed stop member on a frame, for example, may be used to limit the upward level to which trays 79 and 80 may be biased. Thus, while the feed rollers still rotate, feeding of sheets is halted until the next sheet is to be fed.

Attention is now directed to FIGS. 6 through 9 for a more complete discussion of the structure and operation of the restrictor member of the present invention. The restrictor member 130 comprises two restrictor arms 131 and 132 attached or mounted to a restrictor shaft 133 which in turn is mounted to mounting hubs 134 and 135 at the rear of the duplex tray feeder arm 95. The restrictor arms 131 and 132 have apertures therein 137 and 138 respectively. The restrictor member also has a sheet guide member 139 as well as a support member 140 between the two restrictor arms 131 and 132 and extending a length such that the feed roll 98 may be positioned within the restrictor arms 131 and 132. While the restrictor member may be made from a plurality of individual parts which are individually fabricated, it is preferred to provide a restrictor member in the form of a one piece molded plastic part. The restrictor member is assembled such that the two restrictor arms 131 and 132 are provided on each side of the feed roll 98. Since the apertures 137 and 138 in the restrictor arms are larger than the diameter of the feed roll shaft 97, the restrictor arms are free to pivot about the restrictor shaft 133 by gravity to provide a location at the bottom of the restrictor arm 131 below the level of the bottom of feed roll 98. The apertures 137 and 138 are large enough that in the retracted or non-feeding position, the bottom of restrictor arms 131, 132 are below the bottom of the feed roll 98 while when in the feeding position the arms can be moved upwardly to enable contact of the top sheet with the feed roll without the arms touching shaft 97. This is enabled since the restrictor member 130 is free to rotate on its shaft 133 which is fixedly mounted on duplex tray feeder arm 95. Accordingly, when the feed rolls are retracted from feeding engagement with the top sheet, the restrictor member pivots by gravity with the two restrictor arms coming into contact with the top sheet and maintaining the top sheets spaced from the feed rolls. Accordingly, the weight of the restrictor member is sufficient to maintain the top sheet spaced from the rotatable feed roll when the feed roll is in the retracted standby position. In order to ensure the desired level of sheet feeding performance when the feed roll is in the sheet feeding position, it is preferred that the weight of the restrictor member be insufficient to substantially inhibit the sheet feeding performance of the feed roll when it is in the sheet feeding position. Furthermore, by choosing a suitable angle for the rear portion of the restrictor arms and providing a guide member 139 extending between the arms, the restrictor member provides an additional sheet guiding function during insertion of sheets in the duplex tray. This geometry is also effective in reducing unwanted feeding or multisheet feeding caused by static electricity by not permitting a sheet to contact the feed roll when static electricity on the roll or the sheets tries to pull the sheet to the roll. As previously mentioned this is a difficulty that can also be encountered in the feeding of virgin sheets.

Figure 1A:
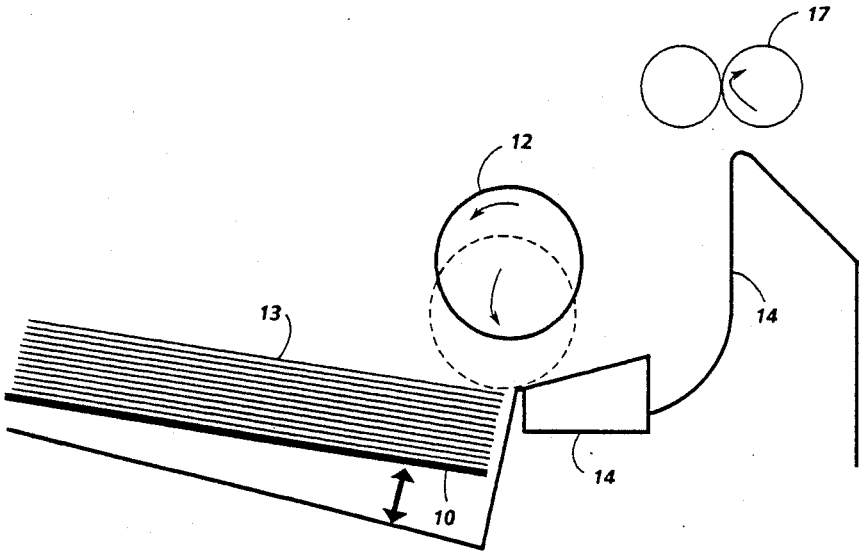
FIG. 1A and 1B are schematic sectional representations of sheet feeders with an articulating feed roll where the sheet stack is new or virgin paper (FIG. 1A) and where the sheet stack has already passed through the fuser once (FIG. 1B)
Figure 1B:
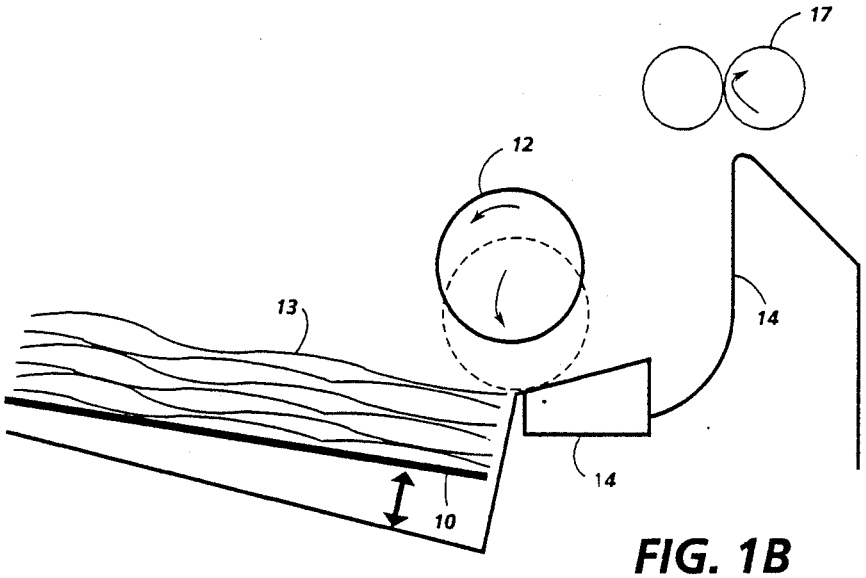
Figure 7:
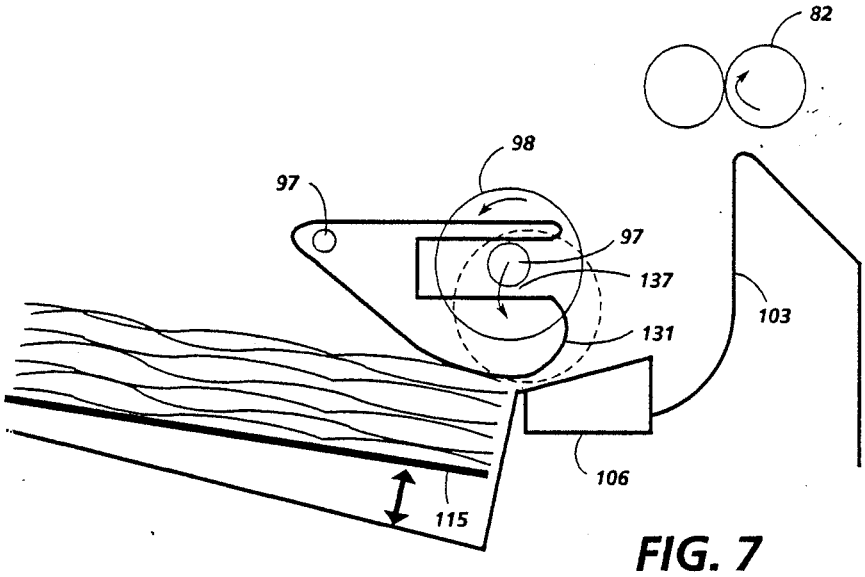
FIG. 7 illustrates in a schematic cross section representation an articulating feed roll with a restrictor member according to the present invention.
Figure 8:
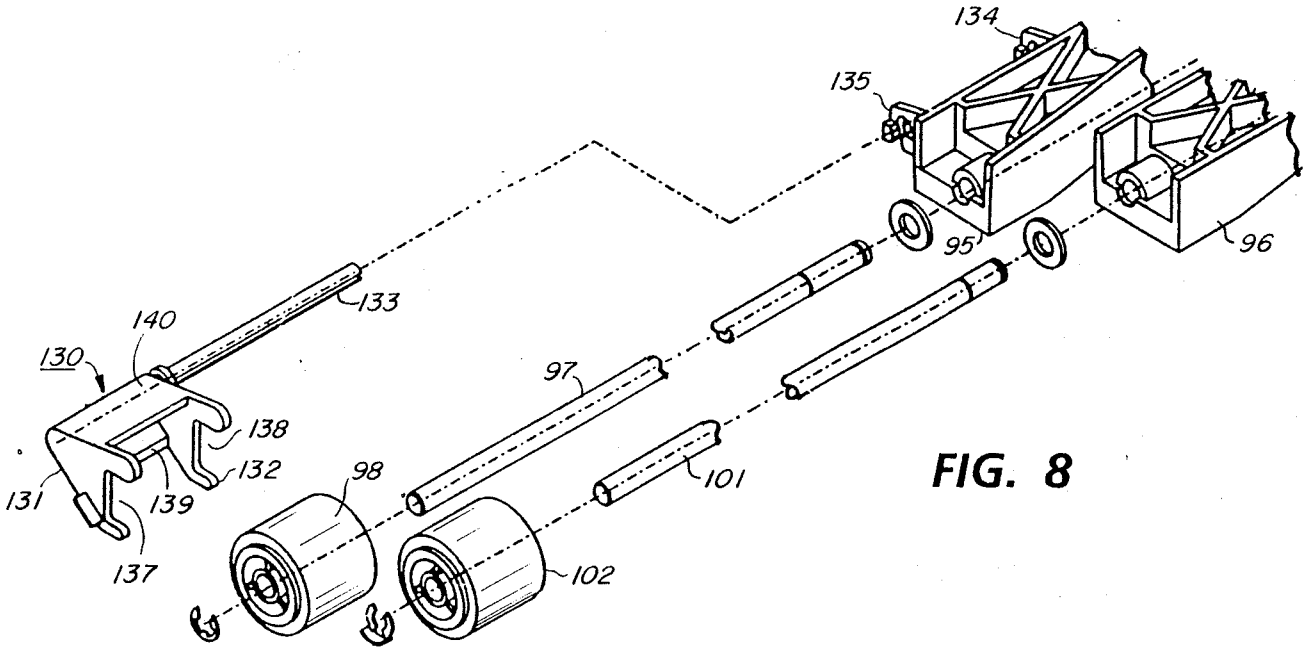
FIG. 8 is an isometric view of the feeder toggle carriage illustrating the restrictor member according to the present invention.
Figure 9:
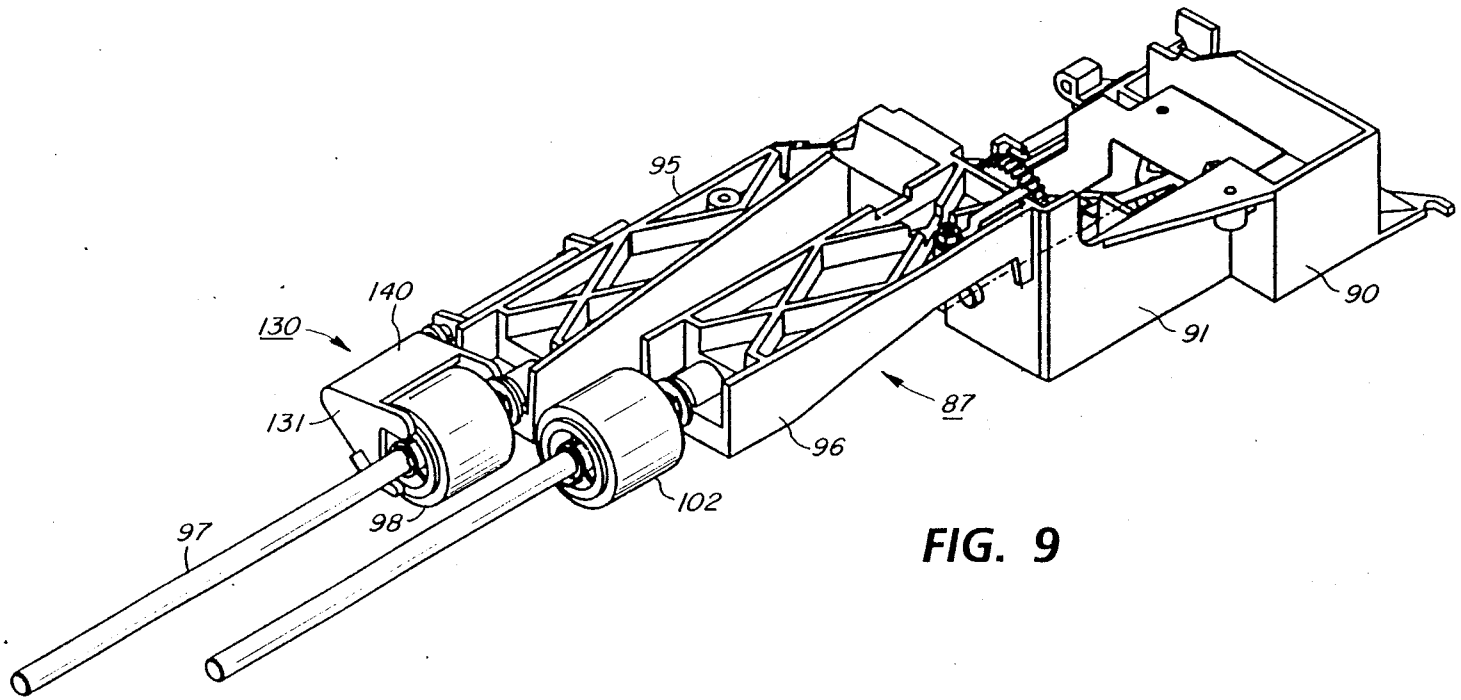
FIG. 9 is an exploded view of a feed roll and restrictor member according to the present invention.

While the manner of operation is believed clear from the above description, attention is directed FIG. 7 in comparison to FIG. 1 wherein the action of the restrictor member in maintaining the top sheet of a stack of sheets with curl and other stacking difficulties associated with at least a first pass through a printing machine is depicted. By locating the restrictor member such that one arm is on each side of the feed roll, the restrictor member is able to maintain the top sheets spaced from the rotatable to thereby ensure that there will be no unwanted feeding of the sheet when the feed roll is in the retracted standby position.

Thus, according to the present invention, a device is provided for restricting the upward movement of a curled sheet in a stack of sheets so that it does not contact a feed roll when in the retracted standby position. More specifically, a device which enables the refeeding of substrates having fused toner image thereon to an electrostatographic printing machine for a second or subsequent pass is provided which does not suffer from the difficulty associated with sheets which have already passed through an electrostatographic fuser system. While the apparatus has been illustrated for a feeding head wherein the feed roll is continuously rotated, it will be understood that the invention has equal applicability to a feed roll which is intermittently driven. This may be accomplished by providing suitable clutches and clutching controls for the feed roll. In addition, the restrictor member has the advantage in that it can be designed to provide a sheet guide to incoming sheets into the duplex tray in the embodiment illustrated. The device in accordance with the present invention has the advantage in that it is very inexpensive to manufacture or to assemble and accomplishes its objective without the need for additional power.

The disclosure of the patents referred to herein is specifically and totally incorporated herein by reference.

While the invention has been described with references to specific embodiment it will apparent to those skilled in the art that many alternatives, modifications and variations may be made. For example, while the invention has been illustrated with reference to a printing machine wherein an electrostatic latent image is formed by optically scanning an original, it will be appreciated that the electrostatic latent image may be created in other ways such by a modulated beam of light from a laser beam. Accordingly, it is intended to embrace all such modifications and alternatives as may fall within the spirit and scope of the appended claims.

I claim:

1. A sheet feeder for feeding sheets from a support platform comprising a sheet support platform, a rotatable sheet feed roll, means to reciprocally move said feed roll between a sheet feeding position wherein said feed roll is in feeding engagement with the top sheet when at least one sheet is on said support platform and a retracted standby position wherein said feed roll is retracted from feeding engagement with said top sheet, a movable sheet restrictor member positioned by gravity to maintain said top sheet spaced from said rotatable feed roll when said feed roll is in the retracted standby position.

2. The sheet feeder of claim 1 wherein said feed roll is rotatably mounted on a feed arm which is reciprocally mounted to move said feed roll between said sheet feeding position and said retracted standby position and wherein said movable sheet restrictor member comprises two restrictor arms one on each side of said feed roll, said restrictor arms being pivotally mounted to a shaft fixedly located relative to said feed arm to enable said restrictor arms to pivot about said shaft by gravity when said feed roll is in the retracted standby position.

3. The sheet feeder of claim 2 wherein said two restrictor arms have apertures therein through which said feed arm extends, said apertures being larger than said feed arm whereby said restrictor arms are pivotally movable about said feed arm.

4. The sheet feeder of claim 1 wherein said sheet restrictor member is of sufficient weight to maintain said top sheet spaced from said rotatable feed roll when said feed roll is in the retracted standby position and of insufficient weight to substantially inhibit the sheet feeding performance of said feed roll when it is in the sheet feeding position.

5. The sheet feeder of claim 1 further including friction retard means for cooperative engagement with said feed roller forming a nip therebetween when said feed roller is in said sheet feeding position.

6. The sheet feeder of claim 5 including means to reciprocally move said feed roll for the feeding of every sheet.

7. The sheet feeder of claim 6 including means to continuously rotate said feed roll.

8. The sheet feeder of claim 5 including means to maintain said feed roll at the sheet feeding position for the feeding of successive sheets and further including means to rotate said feed roll periodically for the feeding of successive sheets.

9. A printing machine comprising means to form a toner image on a sheet substrate, means to heat fuse said toner image to said substrate, a paper path including means to transport said sheet substrate from a supply of sheets through said means to form and said means to heat fuse and including a sheet substrate collection tray for collecting sheet substrates having at least one fused toner image thereon, said tray having a sheet support platform and operatively associated therewith a sheet feeder for feeding said sheets having at least one fused toner image thereon, said sheet feeder comprising a rotatable sheet feed roll, means to reciprocally move said feed roll between a sheet feeding position wherein said feed roll is in feeding engagement with the top sheet when at least one sheet is on said support platform and a retracted standby position wherein said feed roll is retracted from feeding engagement with said top sheet, a movable sheet restrictor member positioned by gravity to maintain said top sheet spaced from said rotatable feed roll when said feed roll is in the retracted standby position.

10. The printing machine of claim 9 wherein said feed roll is rotatably mounted on a feed arm which is reciprocally mounted to move said feed roll between said sheet feeding position and said retracted standby position and wherein said movable sheet restrictor member comprises two restrictor arms one on each side of said feed roll, said restrictor arms being pivotally mounted to a shaft fixedly located relative to said feed arm to enable said restrictor arms to pivot about said shaft by gravity when said feed roll is in the retracted standby position.

11. The printing machine of claim 10 wherein said two restrictor arms have apertures therein through which said feed arm extends, said apertures being larger than said feed arm whereby said restrictor arms are pivotally movable about said feed arm.

12. The printing machine of claim 9 wherein said sheet restrictor member is of sufficient weight to maintain said top sheet spaced from said rotatable feed roll when said feed roll is in the retracted standby position and of insufficient weight to substantially inhibit the sheet feeding performance of said feed roll when it is in the sheet feeding position.

13. The printing machine of claim 9 further including friction retard means for cooperative engagement with said feed roller forming a nip therebetween when said feed roller is in said sheet feeding position.

14. The sheet feeder of claim 13 including means to reciprocally move said feed roll for the feeding of every sheet.

15. The sheet feeder of claim 14 including means to continuously rotate said feed roll.

16. The sheet feeder of claim 13 including means to maintain said feed roll at the sheet feeding position for the feeding of successive sheets and further including means to rotate said feed roll periodically for the feeding of successive sheets.

17. The printing machine of claim 9 including paper path means to transport said sheets having at least one fused toner image thereon through said means to form said toner image and said means to heat fuse said toner at least once.

18. The printing machine of claim 17 wherein said sheet substrate collection tray is a duplex buffer tray for storing sheet substrates having one fused toner image one side for transport through said printing machine to receive a toner image on the side.

19. The printing machine of claim 10 wherein said restrictor arms are connected by a guide member to guide sheets into said sheet substrate collection tray.

* * * * *